US007383954B2

(12) United States Patent
Morrison

(10) Patent No.: US 7,383,954 B2
(45) Date of Patent: Jun. 10, 2008

(54) STORAGE AND DISPLAY PACKAGE FOR BATTERIES

(76) Inventor: David J. Morrison, 3338 Rutledge Dr., Las Vegas, NV (US) 89120

( * ) Notice: Subject to any disclaimer, the term of this patent is extended or adjusted under 35 U.S.C. 154(b) by 157 days.

(21) Appl. No.: 11/355,108

(22) Filed: Feb. 16, 2006

(65) Prior Publication Data

US 2006/0131208 A1 Jun. 22, 2006

Related U.S. Application Data

(63) Continuation-in-part of application No. 10/981,648, filed on Nov. 5, 2004, now abandoned.

(51) Int. Cl.
*B65D 73/00* (2006.01)

(52) U.S. Cl. ..... 206/576; 206/705; 206/480; 206/471; 248/311.2; 248/316.8

(58) Field of Classification Search ..... 248/205.3, 248/110, 68.1, 311.2, 316.8; 206/480, 477, 206/478, 467, 471, 483, 379, 377, 703, 705, 206/576

See application file for complete search history.

(56) References Cited

U.S. PATENT DOCUMENTS

| | | | | | |
|---|---|---|---|---|---|
| 539,720 | A | * | 5/1895 | Bischoff | 206/480 |
| 808,596 | A | * | 12/1905 | Blakeslee | 206/480 |
| 1,389,984 | A | | 9/1921 | Reed | |
| 1,587,356 | A | | 6/1926 | Riebeth | |
| 1,655,881 | A | | 1/1928 | Steeves | |
| D156,729 | S | | 1/1950 | Hampe et al. | |
| 2,616,751 | A | | 11/1952 | Goldenberg | |
| 3,428,171 | A | | 2/1969 | Blish | |
| 3,696,920 | A | * | 10/1972 | Lahay | 206/370 |
| 3,913,734 | A | | 10/1975 | Siegel | |
| 3,946,877 | A | * | 3/1976 | Galicia | 211/65 |
| 4,130,200 | A | | 12/1978 | Iepson et al. | |
| D252,429 | S | | 7/1979 | Morin | |
| 4,205,620 | A | | 6/1980 | Keys | |
| 4,266,667 | A | | 5/1981 | Ishigaki | |
| D262,337 | S | | 12/1981 | Bateman et al. | |
| 4,420,082 | A | | 12/1983 | Bernie | |
| D273,162 | S | | 3/1984 | Halverson | |
| 4,549,654 | A | * | 10/1985 | Tiesman | 206/486 |
| 4,637,580 | A | | 1/1987 | Idstein | |

(Continued)

FOREIGN PATENT DOCUMENTS

| | | |
|---|---|---|
| JP | 10-165269 | 6/1998 |

(Continued)

*Primary Examiner*—Jacob K Ackun, Jr.
(74) *Attorney, Agent, or Firm*—Richard C. Litman

(57) ABSTRACT

The storage and display package for batteries is a blister pack that can be secured in a vertical position on cabinet doors, sheds and RV walls. The package allows the user to access individual batteries from the front or top of the package, while the package is secured in such locations. The package may have a perforated, removable top section or a reclosable flap on the front of the package. The package may alternatively include a clip that may be removed from the package and secured in the stated locations with the batteries held in the clip. The package and clip may alternatively be modified to support both batteries and a household device that uses the batteries.

5 Claims, 15 Drawing Sheets

U.S. PATENT DOCUMENTS 4,693,441 A 9/1987 Conway
4,696,402 A 9/1987 Harmon et al.
4,702,975 A 10/1987 Fields
5,117,976 A 6/1992 Whitt et al.
5,209,354 A 5/1993 Thornhill et al.
5,484,066 A * 1/1996 Luisi ..... 211/69.8
5,499,713 A 3/1996 Huffer
5,544,755 A 8/1996 Paumen et al.
5,579,928 A 12/1996 Anukwuem
5,655,673 A 8/1997 Weterrings et al.
5,735,404 A 4/1998 Kumakura et al.
5,820,095 A * 10/1998 Stone ..... 248/316.7
5,871,100 A 2/1999 Ward
5,899,333 A 5/1999 Williams et al.
5,947,297 A 9/1999 Aoki et al.
D424,933 S 5/2000 Albright et al.
D425,417 S 5/2000 Gaffney et al.
6,071,583 A 6/2000 Pomerantz
6,119,864 A 9/2000 Kessler et al.
6,164,490 A 12/2000 Bishop et al.
6,244,444 B1 6/2001 Jacobus et al.
6,308,832 B1 10/2001 Pirro et al.
6,478,158 B2 12/2001 Gaffney et al.
6,382,420 B1 5/2002 Bouthiette
6,427,841 B2 8/2002 Wani et al.
6,439,390 B1 8/2002 Kumakura et al.
D486,010 S 2/2004 Scola
6,736,267 B2 5/2004 Schamante
2001/0052478 A1 12/2001 Casanova et al.
2004/0004018 A1* 1/2004 Nittono et al. ..... 206/461
2004/0020883 A1 2/2004 Brokaw
2004/0112790 A1 6/2004 Lee et al.
2004/0182802 A1 9/2004 Paul
2005/0042502 A1* 2/2005 Becker ..... 429/99

FOREIGN PATENT DOCUMENTS

JP 2002-2769 1/2002

* cited by examiner

STORAGE AND DISPLAY PACKAGE FOR BATTERIES

CROSS-REFERENCE TO RELATED APPLICATION

This application is a continuation-in-part of my prior application, Ser. No. 10/981,648, filed Nov. 5, 2004 now abandoned.

BACKGROUND OF THE INVENTION

1. Field of the Invention

The present invention relates to packaging. More specifically, the invention relates to packaging for sale, display and storage of small household items, such as batteries and battery-powered devices.

2. Description of the Related Art

Batteries and other household items have, for many years, been sold in packaging conventionally known as "blister packs". These packs include a clear plastic covering over the items, which allow them to be seen by the potential customer. Often, batteries are sold in large quantities within the same blister pack. While this packaging is quite helpful in promoting the batteries before sale, it is not entirely useful once the consumer gets the batteries home.

With conventional blister packs, the consumer often would open the blister pack to use one or two batteries, and then would leave the remaining unused batteries lying loose in the "junk drawer". Improvements in the blister packs have allowed the consumer to access only the number of batteries needed, and then store the remaining unused batteries in the blister pack until needed. However, these packs are still being left in the "junk drawer" or otherwise packed away until a later need.

Most devices that use batteries are not generally used or stored in the same location the batteries are stored in. There is, therefore, a need for battery packaging that retains the before-sale advantages of conventional blister packs, while allowing the batteries to be stored in a protective pack that can be kept in an easily accessible location near where the consumer would typically need the batteries. There is also a need for packaging that allows the consumer access to the individual batteries while the package is stored in such a location.

SUMMARY OF THE INVENTION

The storage and display package for batteries is a blister pack that can be removably secured in a vertical position on cabinet doors, sheds and RV walls. The package allows the user to access individual batteries from the front or top of the package, while the package is secured in such locations. The package may have a perforated, removable top section or a reclosable flap on the front of the package. The package may alternatively include a clip that may be removed from the package and secured in the stated locations with the batteries held in the clip.

Using a blister pack design, the package includes a display card that may have indicia printed on it. The display card may include a hole to allow the package to be hung from a hook or peg while on display before sale. A thermoplastic or other clear protective container is secured to the display card. In the case of a thermoplastic container, a heat seal is used around the edges of the container to affix the container to the display card. The container may take any shape that may reasonably hold the product contained within it, but recent conventional blister packs are generally rectangular in shape with indents formed in the thermoplastic to conform the container to the shape of the batteries and better hold the batteries in place.

The package has at least one adhesive strip affixed to the back of the display card. The shape and size of the adhesive strip may vary, so long as the strip can support a full battery pack when secured to a vertical surface.

In the first described embodiment of the packaging, the display card and thermoplastic container have perforations running across the package. These perforations allow the package to be torn open in such a manner as to create an open top container. The adhesive strip is affixed to the back of the display card below the perforations, so that when the packaging is opened, the open package may still be secured to the cabinet door, shed wall, RV walls or any other vertical surfaces near where batteries may be needed. The individual batteries may be removed from the open package as needed, leaving the unused batteries in an organized, easily accessible location.

In an alternative embodiment, the perforations may only run down from the top edge of the container to a pre-formed crease that runs across the front of the container. A small tab is formed in the display card by a series of perforations. The tab is secured to the top edge of the container using a heat seal. The remainder of the top edge of the container is not sealed to the display card. The tab may be torn from the display card, and the top section of the thermoplastic container may then be pulled forward, folding over the pre-formed crease. This allows the batteries to be removed from the package while retaining the integrity of the remainder of the container so that it may still be used to store batteries. The individual batteries may be removed from the open package as needed, leaving the unused batteries in an organized, easily accessible location.

In a third embodiment of the packaging, a clip with a base and a number of gripping arms holds each of the individual batteries and is held within the thermoplastic container. The clip has a small ledge on the bottom of its base that helps to support the batteries as the batteries are held between the gripping arms. The clip also has an adhesive strip affixed to the back of the base. When the packaging is opened and the clip is removed, the clip may be secured to a vertical surface, with the unused batteries still held within the gripping arms of the clip. Other small household items, such as pill bottles and other toiletries, may also be held in the clip. Again, the individual batteries may be removed from the clip as needed, leaving the unused batteries in an organized, easily accessible location.

In a fourth embodiment of the packaging, a clip with a base, a number of gripping arms and a divider hold each of the individual batteries and a household device within the thermoplastic container. The clip has a small ledge on the divider that helps to support the batteries as the batteries are held between the gripping arms. The clip also has an adhesive strip affixed to the back of the base. When the packaging is opened and the clip is removed, the clip may be secured to a vertical or horizontal surface, with the unused batteries and the device still held within the gripping arms and divider of the clip. The clip may be used to store the household device when the household device is not being used, and the individual batteries may be removed from the clip as needed, leaving the unused batteries in an organized, easily accessible location.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
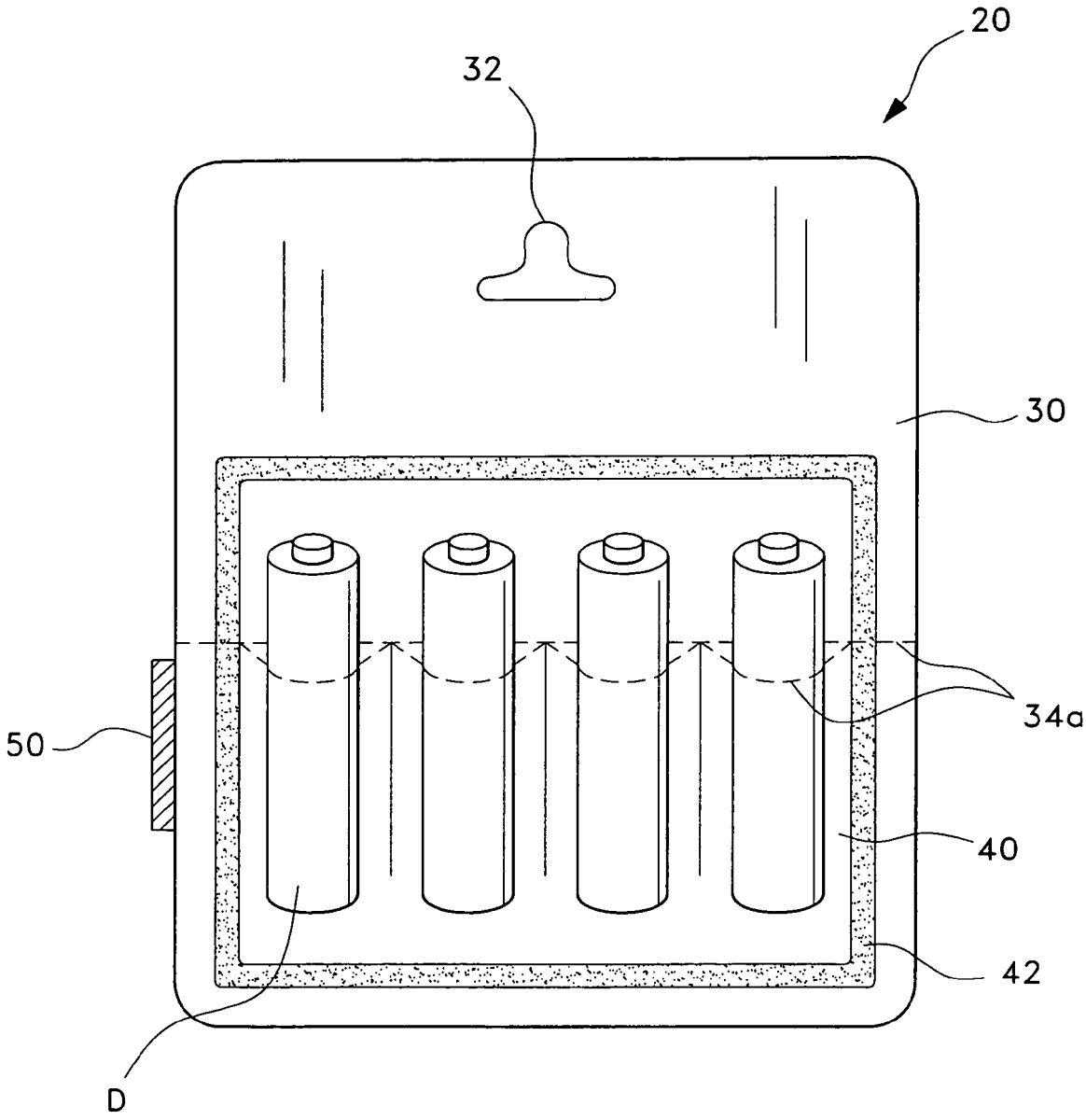
FIG. 1 is a perspective view of a battery package with perforations according to the present invention.

The present invention is a storage and display package for batteries, designated generally in the drawings as 20. The package 20 can be removably secured in a vertical position on cabinet doors, sheds and RV walls. The package 20 allows the user to access individual batteries D from the front or top of the package 20 while the package 20 is secured in such locations.

Figure 3:
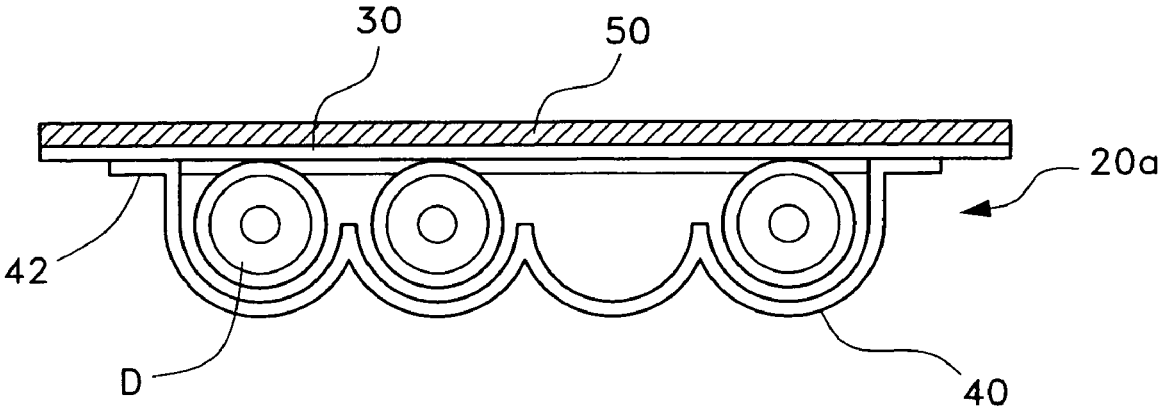
FIG. 3 is a top view of the battery package of FIG. 2.
Figure 4:
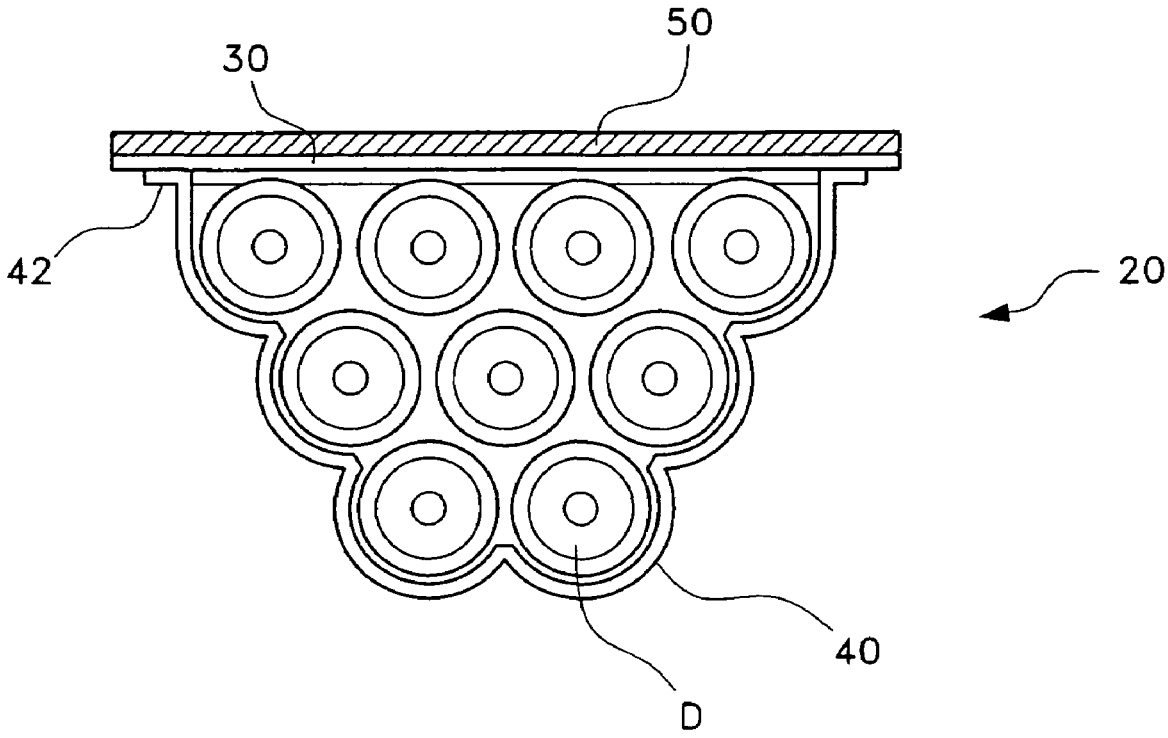
FIG. 4 is a top view of an embodiment of a battery package according to the present invention, the package being opened and configured for more than four batteries.
Figure 5:
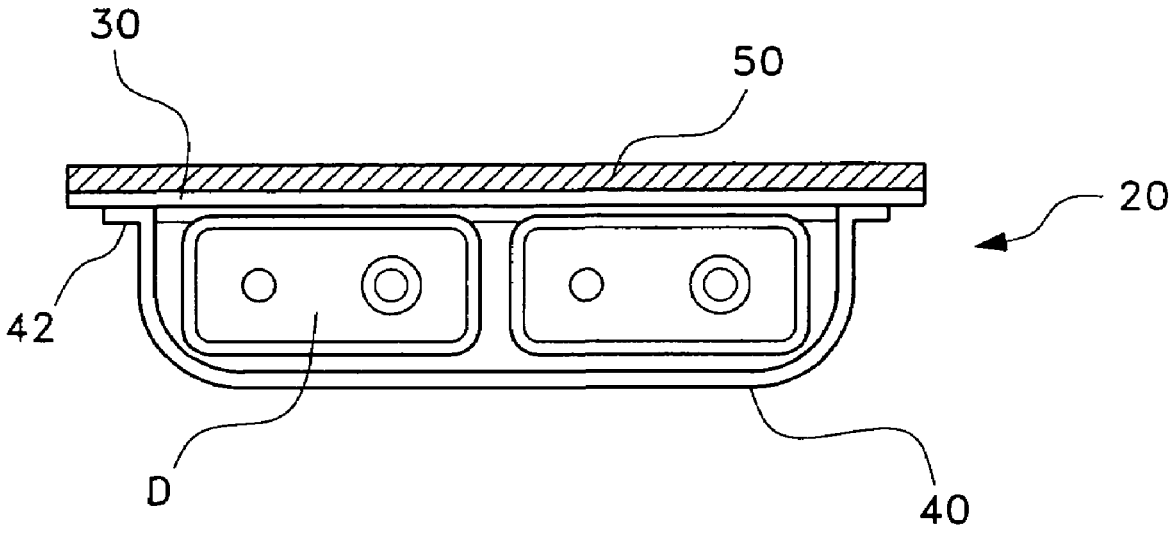
FIG. 5 is a top view of an embodiment of a battery package according to the present invention, the package being opened and configured for rectangular batteries.

Using a conventional blister pack design, the package 20 includes a display card 30 that may have indicia printed on it. As shown in FIG. 1, the display card 30 may include a hole 32 to allow the package 20 to be hung from a hook or peg while on display before sale. A thermoplastic or other clear protective container 40 is secured to the display card 30. In the case of a thermoplastic container, a heat seal 42 is used around the edges of the container 40 to affix the container 40 to the display card 30. The container 40 may take any shape that may reasonably hold the product contained within it, as shown in FIGS. 3-5, but recent conventional blister packs are generally rectangular in shape with indents formed in the thermoplastic to conform the container to the shape of the batteries and better hold the batteries in place.

The package 20 has at least one adhesive strip 50 affixed to the back of the display card 30. The shape and size of the adhesive strip 50 may vary, so long as the strip 50 can support a full battery pack 20 when secured to a vertical surface.

Figure 2:
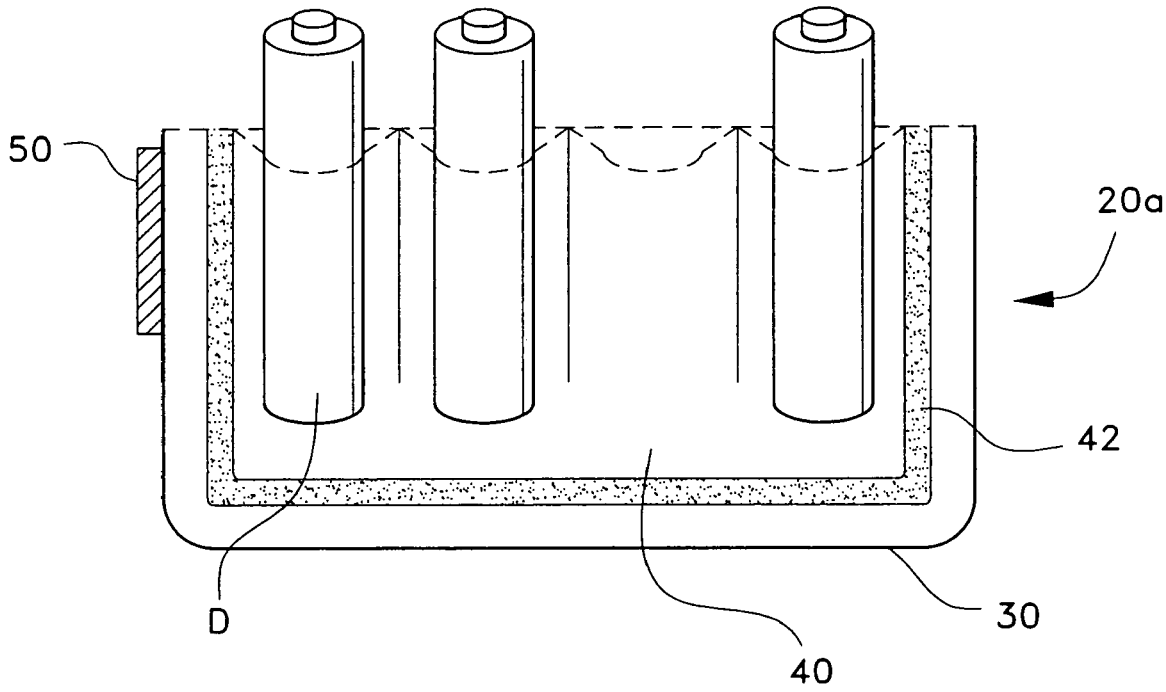
FIG. 2 is a perspective view of the battery package of FIG. 1 in an opened condition.

In the first described embodiment of the packaging 20*a*, as shown in FIGS. 1 and 2, the display card 30 and thermoplastic container 40 have perforations 34*a* running across the package 20*a*. These perforations 34*a* allow the package 20*a* to be torn open in such a manner as to create an open top container. The adhesive strip 50 is affixed to the back of the display card 30 below the perforations 34*a*, so that when the packaging 20*a* is opened, the open package 20*a* may still be secured to the cabinet door, shed wall, RV wall, or any other vertical surface near where batteries may be needed. The individual batteries D may be removed from the open package 20*a* as needed, leaving the unused batteries D in an organized, easily accessible location.

Figure 6:
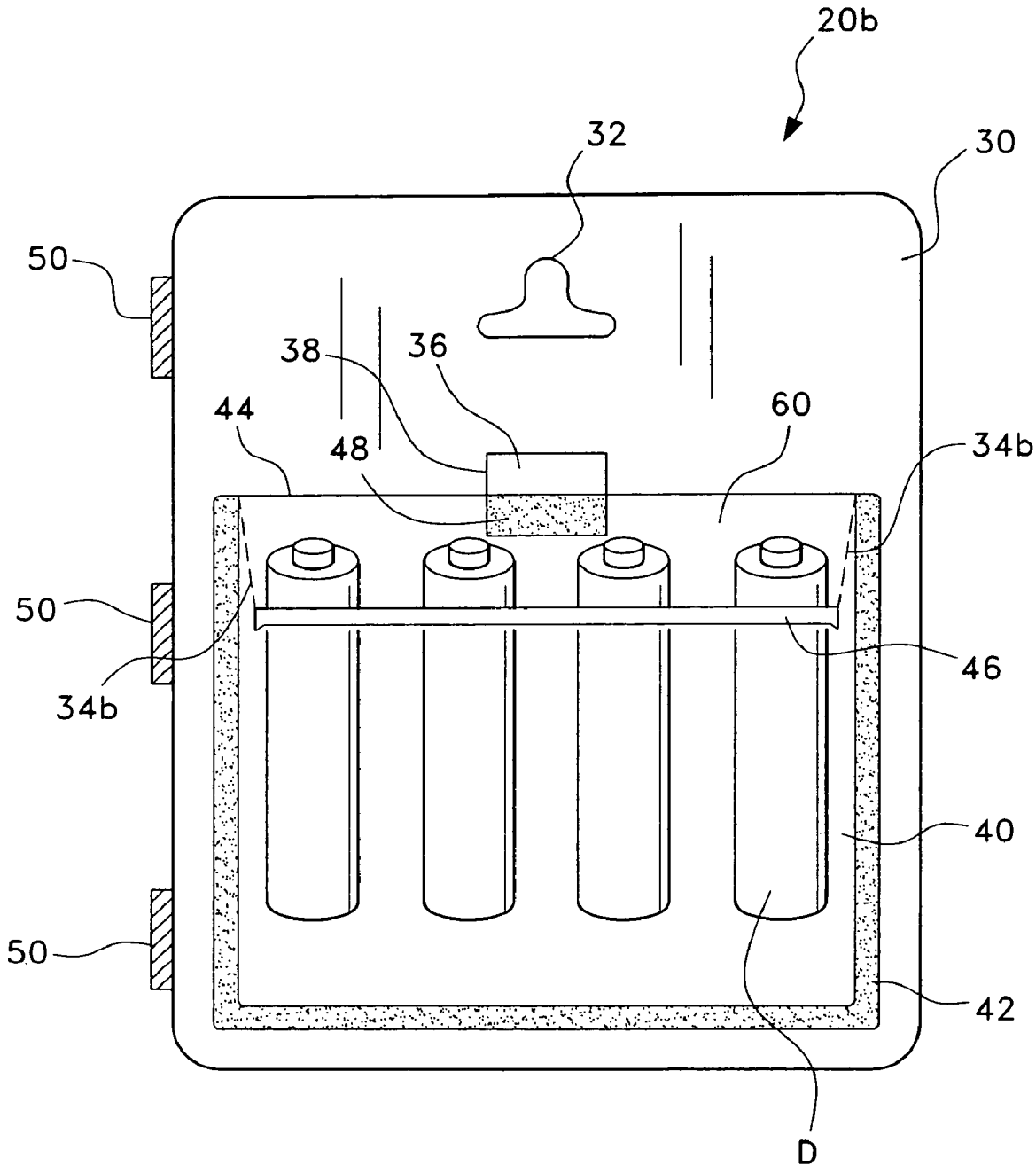
FIG. 6 is a perspective view of another embodiment of a battery package according to the present invention having a front opening flap.
Figure 7:
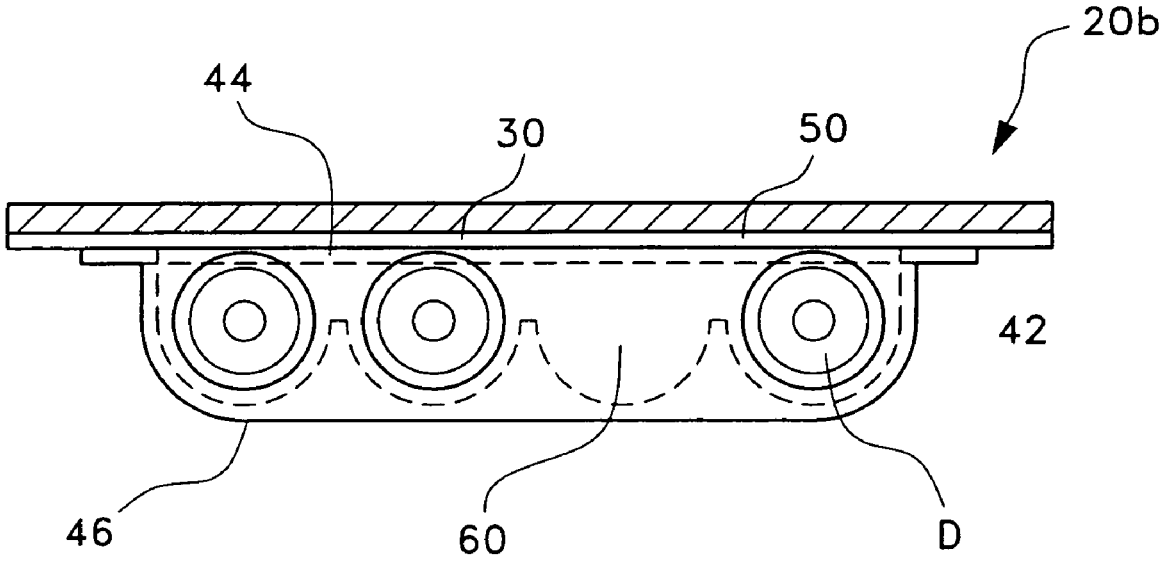
FIG. 7 is a top view of the battery package of FIG. 6.
Figure 8:
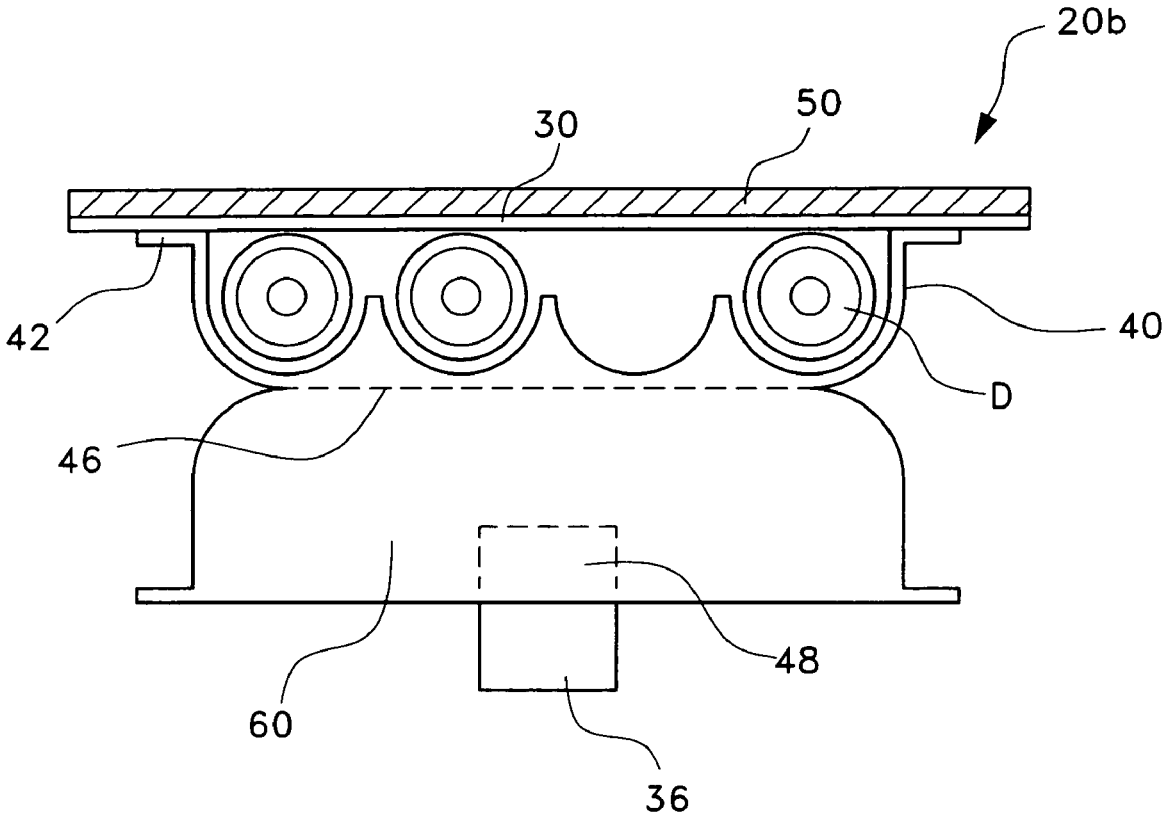
FIG. 8 is a top view of the battery package of FIG. 6, shown with the flap opened.

In an alternative embodiment, the packaging 20*b*, as shown in FIGS. 6-8, may have perforations 34*b* that only run down from the top edge 44 of the container 40 to a pre-formed crease 46 that runs across the front of the container 40. A small tab 36 is formed in the display card 30 by a series of perforations 38. The tab 36 is secured to the top edge 44 of the container 40 using a heat seal 48. The remainder of the top edge 44 of the container 40 is not sealed to the display card 30. The tab 36 may be torn from the display card 30, and the top section 60 of the thermoplastic container 40 may then be pulled forward, folding over the pre-formed crease 46. This allows the batteries D to be removed from the package 20*b* while retaining the integrity of the remainder of the container 40 so that the container 40 may still be used to store batteries D. The individual batteries D may be removed from the open package 20*b* as needed, leaving the unused batteries D in an organized, easily accessible location.

Figure 9:
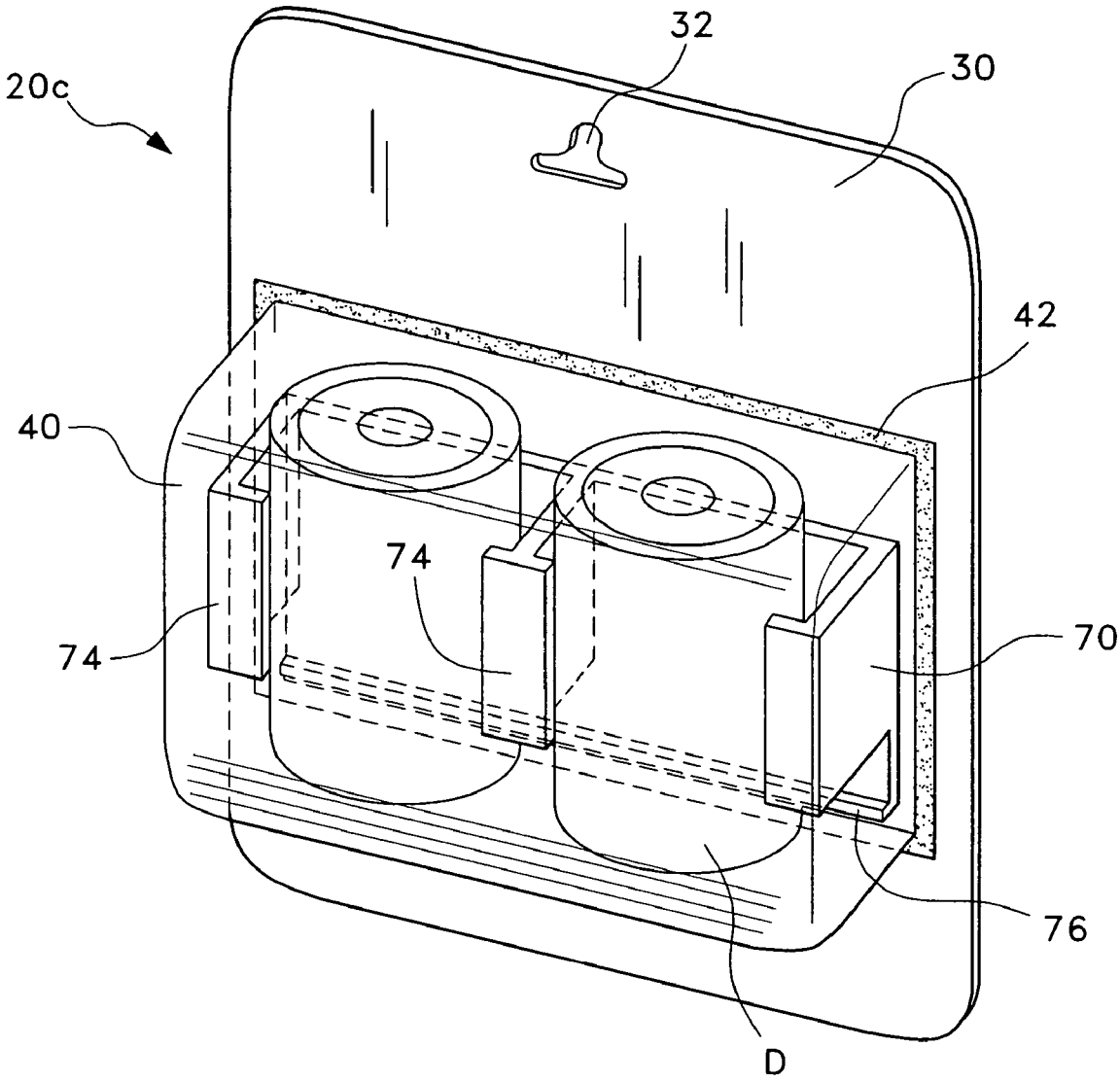
FIG. 9 is a perspective view of another embodiment of a battery package according to the present invention having a battery clip.
Figure 10:
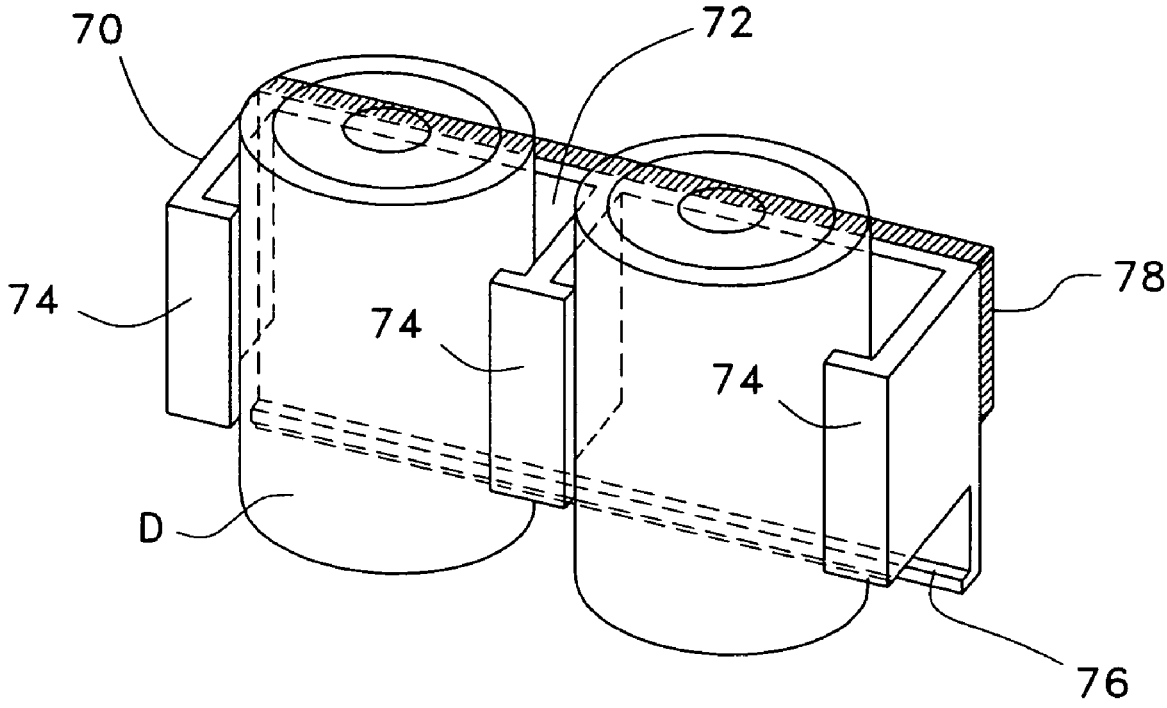
FIG. 10 is a perspective view of the batteries and clip removed from the external battery packaging of FIG. 9.
Figure 11:
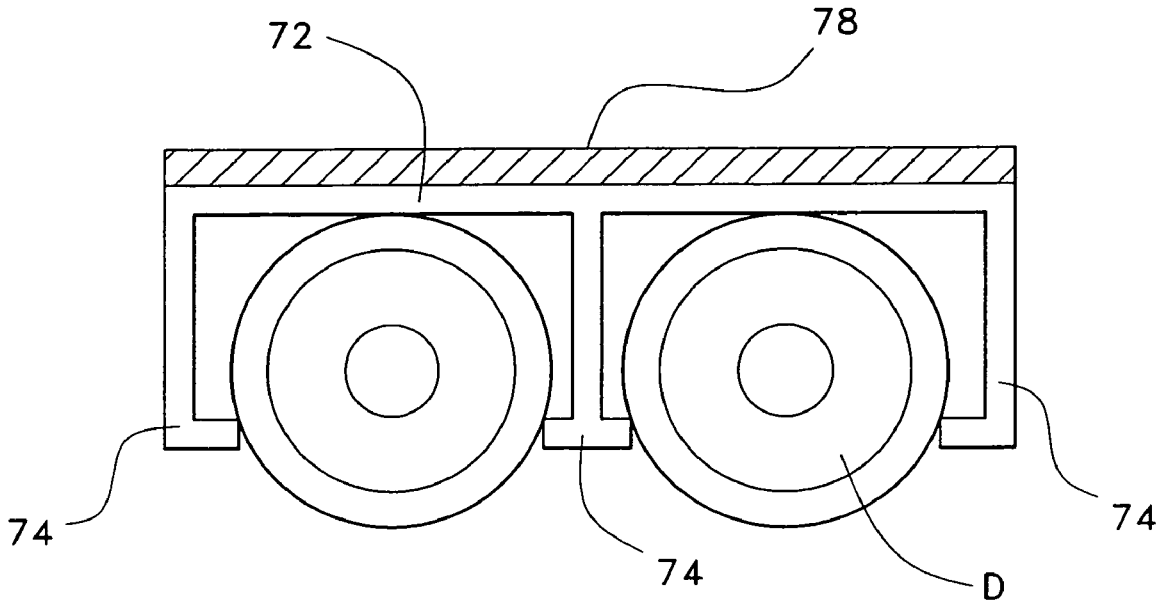
FIG. 11 is a top view of the batteries and clip of FIG. 9.
Figure 12:
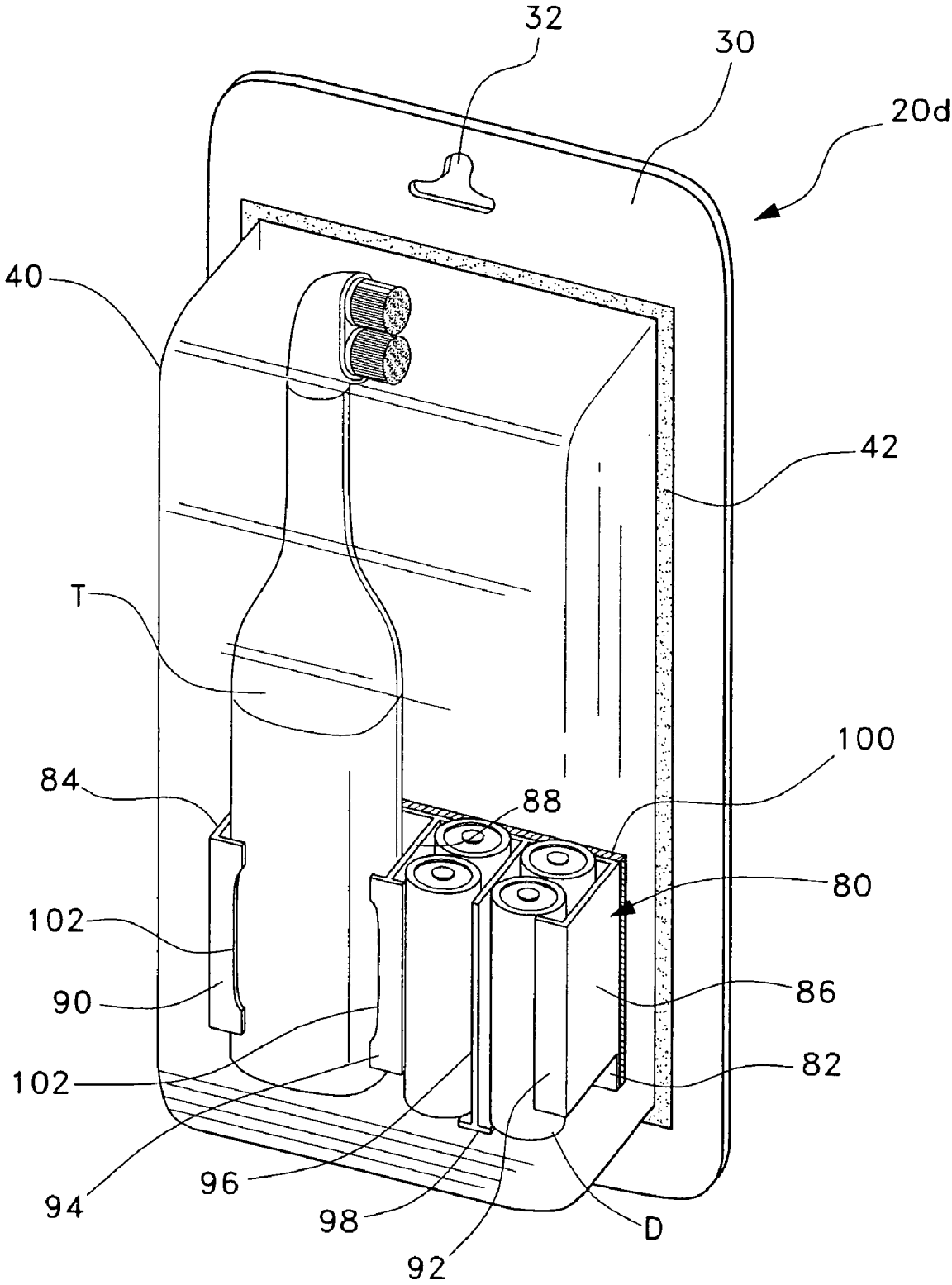
FIG. 12 is an environmental perspective view of another alternative embodiment of a battery package according to the present invention configured for storing and displaying both batteries and a household device.
Figure 13:
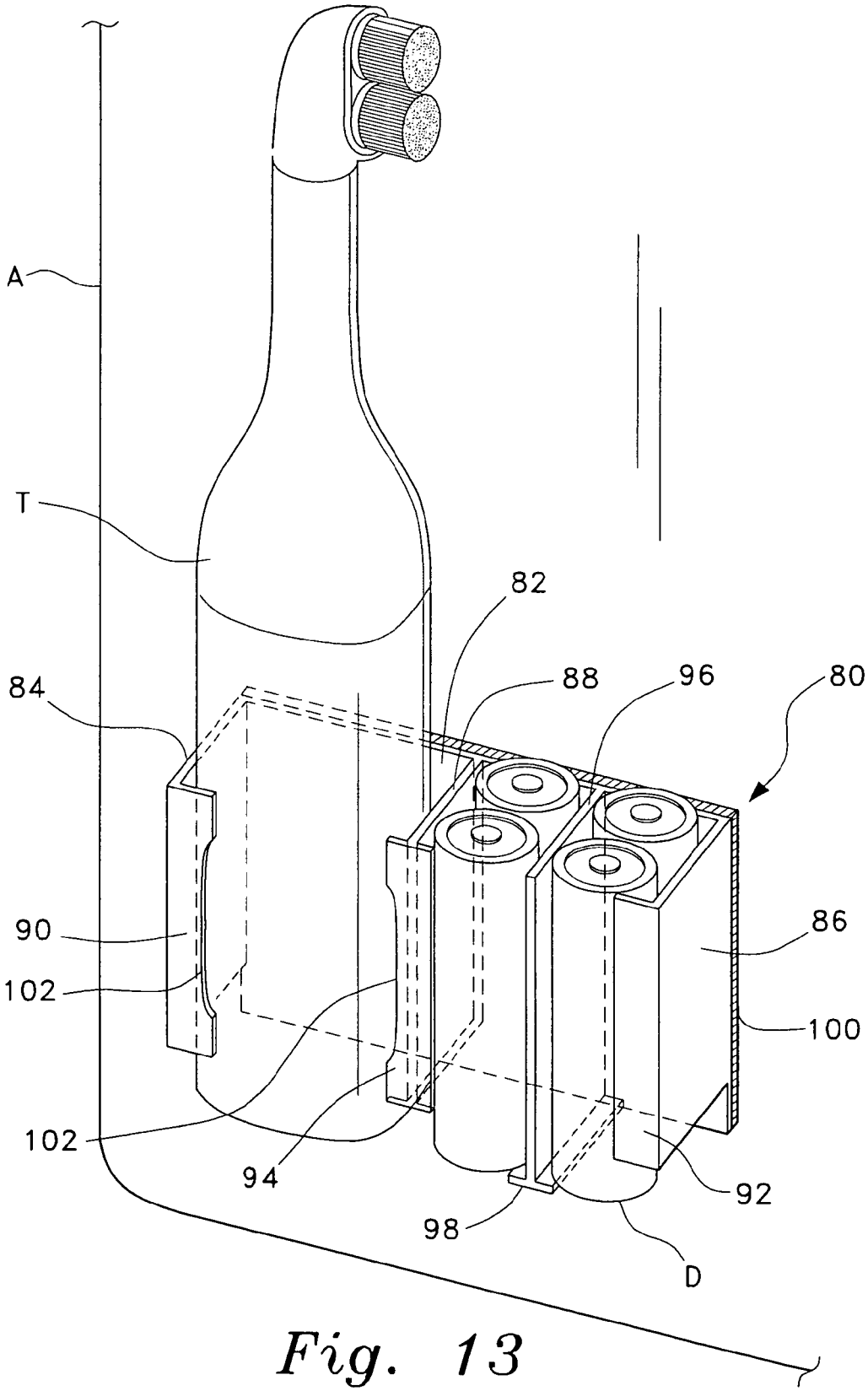
FIG. 13 is a partial environmental perspective view of the batteries and household device of FIG. 12 removed from the external packaging but supported by the package clip according to the present invention, shown attached to a medicine cabinet door.
Figure 14:
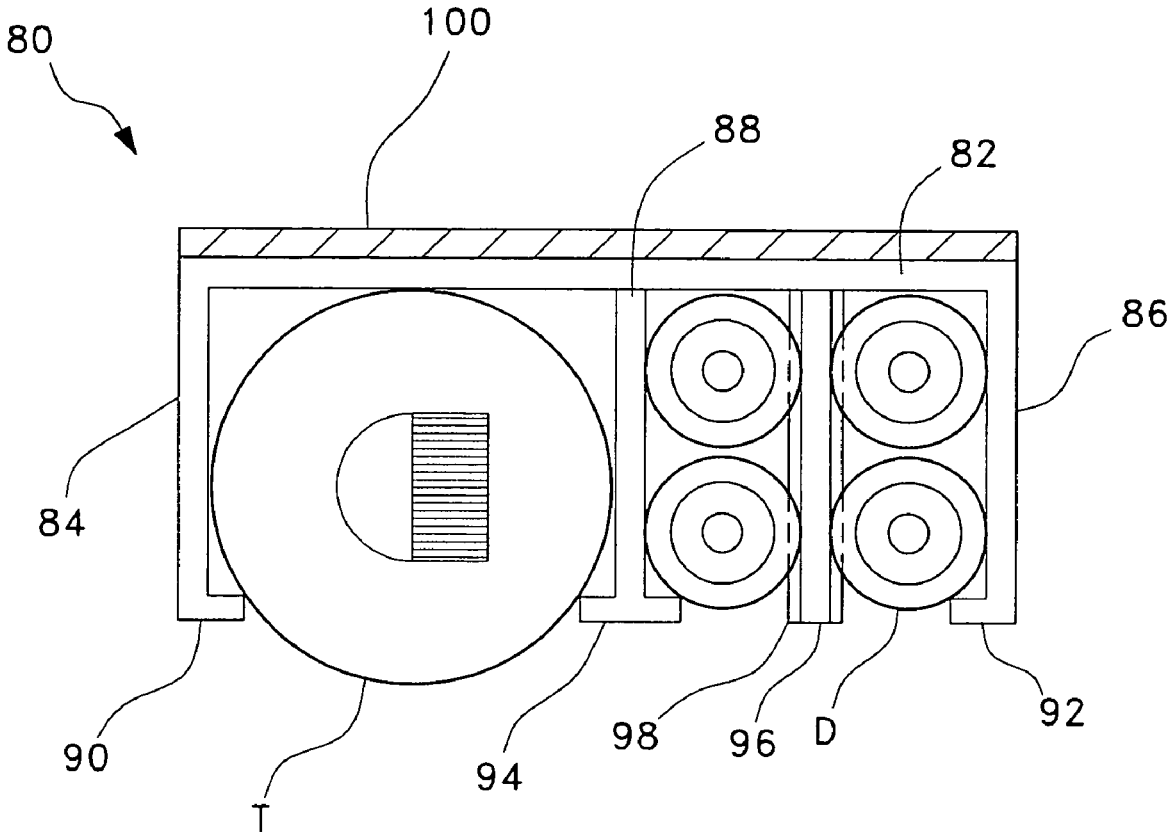
FIG. 14 is an environmental top plan view of the battery package clip of FIGS. 12 and 13, shown supporting batteries and a household device.

In a third embodiment, the packaging 20*c*, as shown in FIGS. 9-11, has a clip 70 with a base 72 and a number of gripping arms 74 holding each of the individual batteries D, the clip 70 being held within the thermoplastic container 40. The clip 70 has a small ledge 76 on the bottom of its base 72 that helps to support the batteries D as they are held between the gripping arms 74. The clip 70 also has an adhesive strip 78 affixed to the back of the base 72. When the packaging 20*c* is opened and the clip 70 is removed, the clip 70 may be secured to a vertical surface, with the unused batteries D still held within the gripping arms 74 of the clip 70. Again, the individual batteries D may be removed from the clip 70 as needed, leaving the unused batteries D in an organized, easily accessible location.

Figure 15:
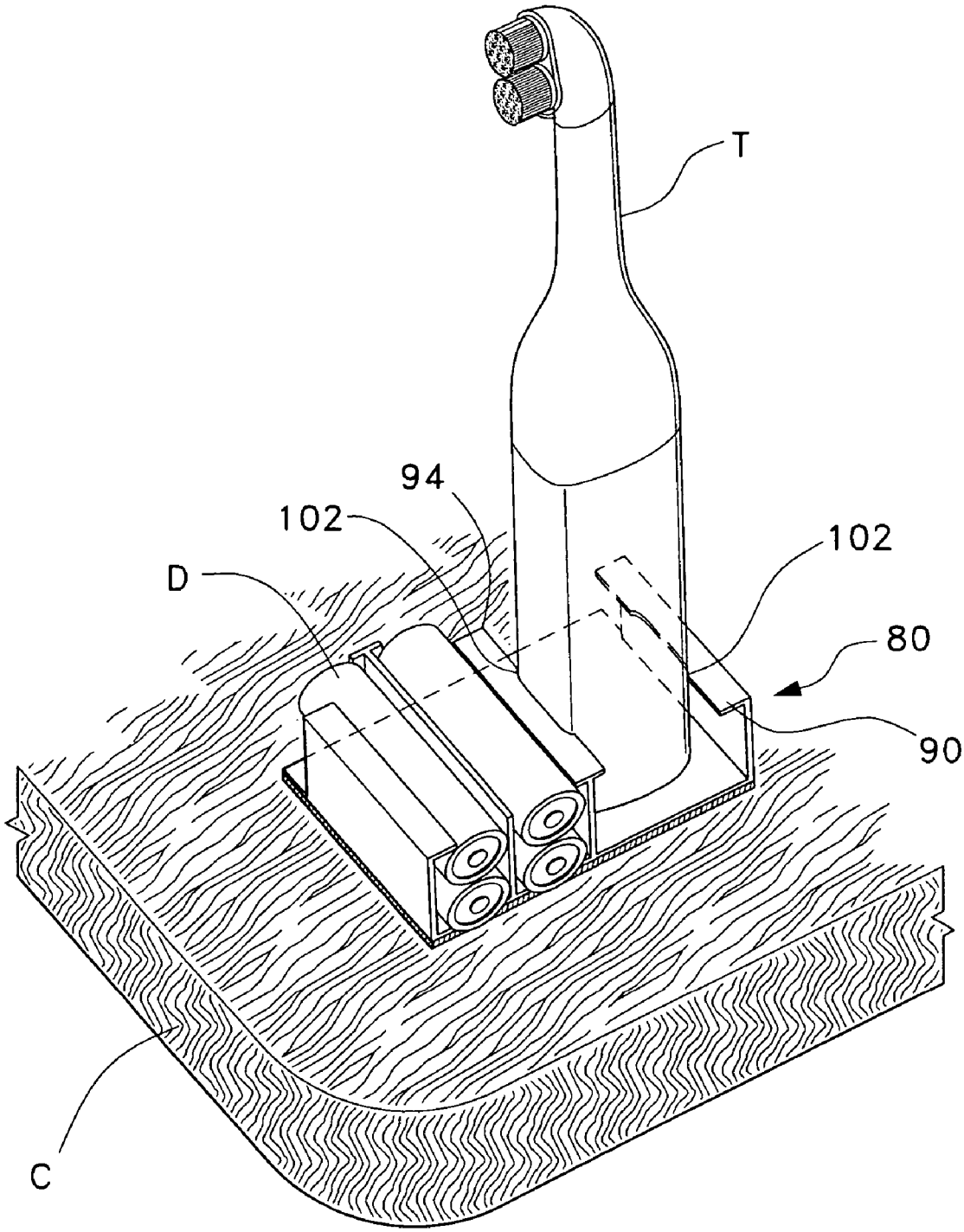
FIG. 15 is an environmental perspective view of an alternative embodiment of the package clip of FIGS. 13 and 14, shown supporting batteries and a household device stored therein.

In a fourth embodiment, the packaging 20*d*, as shown in FIGS. 12-15, has a clip 80 having a base 82, a pair of outer gripping arms 84, 86 and an interior gripping arm 88, so that the clip 80 holds the batteries D and a battery-powered household device T, e.g., a battery-powered toothbrush. The outer gripping arms 84, 86 include end flanges 90, 92, respectively, and interior gripping arm 88 includes flange 94. The flanges 90, 92 and 94 help to grip the batteries D and device T as they are held between the gripping arms 84, 86 and 88. The clip 80 also has a divider 96 extending from its base 82, with a ledge 98 that helps to support the batteries D as they are held between the gripping arms 86 and 88. The clip 80, the batteries D and the device T are held within the thermoplastic container 40, which is secured to the display card 30, by heat seal 42. The display card 30 may include a hole 32 to allow the package 20*d* to be hung from a hook or peg while on display before sale. The clip 80 also has an adhesive strip 100 affixed to the back of the base 82. When the packaging 20*d* is opened and clip 80 is removed, the clip 80 may be secured to a vertical surface A, e.g., a medicine cabinet door, with the device T and the unused batteries D still held between the gripping arms 84, 86, 88 and the divider 96 of the clip 80. When device T in not being used, it may be stored in the clip 80, and the individual batteries D may be removed from the clip 70 as needed, leaving the unused batteries D in an organized, easily accessible location. The facing edges of flanges 90 and 94 include recesses or cutouts 102. As shown in FIG. 15, clip 80 may be supported on a horizontal surface C, e.g., a bathroom countertop, and secured thereto by adhesive strip 100. Cutouts 102 thereby allow device T to be held firmly and securely in an upstanding position between flanges 90, 92 when device T is being stored between uses.

It is to be understood that the present invention is not limited to the embodiments described above, but encompasses any and all embodiments within the scope of the following claims.

I claim:

1. A storage and display package for combined storage and display of a household device and batteries, comprising:

a display card;

a container secured to the display card, the container having at least one clip accommodating portion; and a clip disposed within the container, the clip having a planar base, at least three arms extending from a first side of the base, wherein said at least three arms include a first outer arm, a second outer arm, and an interior arm, each of the arms having a flange disposed at a distal end thereof and extending substantially normal thereto, the flanges have facing edges for retaining the household device and the batteries between the arms, said clip further comprising a divider extending from the first side of said base parallel to said arms, the divider being disposed between said interior arm and the first outer arm, the divider having a ledge extending normal to said base and along one edge of the divider, the divider and the ledge being adapted for supporting the batteries between the first outer arm and said interior arm, and an adhesive strip secured to the base on a second side of the base opposite to the at least three arms, the clip being configured to support batteries and at least one household device between the arms, the clip being adapted to be secured to a surface by the adhesive strip.

2. The storage and display package according to claim 1, wherein said display card has at least one hole formed therein, whereby the package is adapted for being hung on a hook or peg.

3. The storage and display package according to claim 1, wherein the facing edge of the flange on the second outer arm and the facing edge of the flange on said interior arm each have a cut-out defined therein, said clip being adapted for attaching said adhesive strip to a horizontal surface to support said base thereon with the household device securely held in an upstanding position between the cut-outs in the facing edges of said flanges.

4. The storage and display package according to claim 1, further comprising a battery-powered toothbrush, the household device being the battery-powered toothbrush.

5. The storage and display package according to claim 1, wherein said container comprises a thermoplastic container having a heat seal fastening the edges of said container to said display card.

* * * * *